US007839206B2

(12) United States Patent
Abadeer et al.

(10) Patent No.: US 7,839,206 B2
(45) Date of Patent: Nov. 23, 2010

(54) DESIGN STRUCTURE FOR LOW VOLTAGE APPLICATIONS IN AN INTEGRATED CIRCUIT

(75) Inventors: Wagdi W. Abadeer, Jericho, VT (US); Albert M. Chu, Essex Junction, VT (US)

(73) Assignee: International Business Machines Corporation, Armonk, NY (US)

( * ) Notice: Subject to any disclaimer, the term of this patent is extended or adjusted under 35 U.S.C. 154(b) by 464 days.

(21) Appl. No.: 11/851,138

(22) Filed: Sep. 6, 2007

(65) Prior Publication Data

US 2008/0169867 A1 Jul. 17, 2008

Related U.S. Application Data

(63) Continuation-in-part of application No. 11/623,114, filed on Jan. 15, 2007, now Pat. No. 7,498,869.

(51) Int. Cl.
*G05F 1/46* (2006.01)

(52) U.S. Cl. ..... 327/541; 327/543; 323/316

(58) Field of Classification Search ..... None
See application file for complete search history.

(56) References Cited

U.S. PATENT DOCUMENTS 5,703,807 A * 12/1997 Smayling et al. ..... 365/185.03
5,936,392 A * 8/1999 Taylor ..... 323/315
6,172,555 B1 1/2001 Gusinov ..... 327/539
6,756,839 B2 6/2004 Hall et al. ..... 327/538
7,061,308 B2 6/2006 Abadeer et al. ..... 327/543
7,479,820 B2 * 1/2009 Okamoto et al. ..... 327/535
2006/0170487 A1 8/2006 Abadeer et al. ..... 327/538
2007/0257723 A1 * 11/2007 Short et al. ..... 327/333

OTHER PUBLICATIONS

U.S. Appl. No. 11/623,114, Voltage Reference Circuit for Low Voltage Applications in an Integrated Circuit:, Notice of Allowance, Dated: Oct. 16, 2008.
Kuijk, K.E., "A Precision Reference Voltage Source", IEEE Journal of Solid-State Circuits, vol. SC-8, pp. 222-226, Jun. 1973.
Bamba, H. et al., "A CMOS Bandgap Reference Circuit with Sub-1-V Operation", IEEE Journal of Solid-State State Circuits, vol. 34, No. 5, May 1999, pp. 670-674.

* cited by examiner

*Primary Examiner*—Lincoln Donovan
*Assistant Examiner*—Terry L Englund
(74) *Attorney, Agent, or Firm*—David Cain; Roberts Mlotkowski Safran & Cole, P.C.

(57) ABSTRACT

A design structure that includes at least one tunneling device voltage reference circuit for use in low voltage applications is disclosed. The tunneling device voltage reference circuit includes a pair of voltage dividing device stacks, one having a linear voltage output and the other having a non-linear voltage output. A feedback circuit supplies a regulated voltage to each of the voltage dividing stacks so that the output voltages of the two device stacks equalize. Once the feedback circuit has locked, any one of the device stack output voltages and the regulated voltage may be used as a voltage reference.

10 Claims, 7 Drawing Sheets

DESIGN STRUCTURE FOR LOW VOLTAGE APPLICATIONS IN AN INTEGRATED CIRCUIT

CROSS REFERENCE TO RELATED APPLICATIONS

This application is a continuation in part of pending U.S. patent application Ser. No. 11/623,114 filed Jan. 15, 2007, titled: "Voltage reference circuit for low voltage applications in an integrated circuit", issued as U.S. Pat. No. 7,498,869, which is hereby incorporated by reference in its entirety and assigned to the present assignee.

FIELD OF THE DISCLOSURE

The present disclosure generally relates to the field of voltage reference circuits in integrated circuits. In particular, the present disclosure is directed to a design structure comprising a voltage reference circuit for low voltage applications in an integrated circuit.

BACKGROUND

In many integrated circuit designs, it is necessary to have local reference voltages of known values that are stable among process and temperature variations. With advances in semiconductor technology, the semiconductor geometries are decreasing. In particular, with the scaling of semiconductor technologies and the use of ultra-thin gate oxides, the demand for low power and low voltage reference circuits is increasing strongly. A well-known technique for providing a regulated reference voltage is the band gap reference circuit, which may be utilized as a general-purpose voltage regulator circuit for supplying a stable voltage reference in, for example, an integrated circuit. However, a drawback of the traditional band gap reference circuit is that it uses an arrangement of semiconductor diodes that are unable to operate at power supply voltages less than about 1.0 volts, because the forward bias of a diode is around 0.7 volts and, thus, the proper voltage margins may not be maintained. Consequently, as semiconductor technologies advance and the operating voltages decrease, traditional band gap reference techniques have reached the limit of their voltage margins.

For these reasons, a need exists for a voltage reference circuit for use in low voltage applications in an integrated circuit, in order to replace diode-style band gap reference circuits that are unable to operate with power supply voltages that are less than about 1 volt.

SUMMARY OF THE DISCLOSURE

One embodiment is directed to a design structure. The design structure comprises a voltage reference circuit that includes a first voltage divider stack comprising a first input for receiving a regulated voltage, and a first internal node for providing a first divided output voltage. A second voltage divider stack is electrically coupled in parallel with the first voltage divider stack and has a nonlinear relationship to the regulated voltage. The second voltage divider stack comprises a second input for receiving the regulated voltage, and a second internal node for providing a second divided output voltage. A voltage regulator is operatively configured to generate the regulated voltage as a function of the first divided output voltage and the second divided output voltage.

Another embodiment is also directed to a design structure. The design structure comprises a voltage reference circuit that includes a first voltage divider stack comprising a first input for receiving a regulated voltage, and a first internal node for providing a first divided output voltage. A second voltage divider stack is electrically coupled in parallel with the first voltage divider stack. The second voltage divider stack comprises a first leaky capacitor having a first leakage current and including a second input for receiving the regulated voltage. The second voltage divider stack also comprises a second leaky capacitor electrically coupled in series with the first leaky capacitor so as to define a second internal node therebetween for providing a second divided output voltage. A voltage regulator is operatively configured to generate the regulated voltage as a function of the first divided output voltage and the second divided output voltage.

In a further embodiment, the present invention is directed to a method of providing a voltage reference signal. The method comprises dividing a regulated voltage so as to provide a first divided voltage output having a first profile of the first divided output voltage versus the regulated voltage. The regulated voltage is divided so as to provide a second divided voltage having a second profile of the second divided voltage versus the regulated voltage that crosses the first profile at a single crossover voltage. The regulated voltage is generated as a function of the first divided output voltage and the second divided output voltage so that each of the first divided output voltage and the second divided output voltage are substantially equal to one another. At least one of the following is output as a voltage reference signal: the regulated voltage, the first divided output voltage and the second divided output voltage.

BRIEF DESCRIPTION OF THE DRAWINGS

For the purpose of illustrating the invention, the drawings show aspects of one or more embodiments of the invention. However, it should be understood that the present invention is not limited to the precise arrangements and instrumentalities shown in the drawings, wherein.

DETAILED DESCRIPTION

Figure 1:
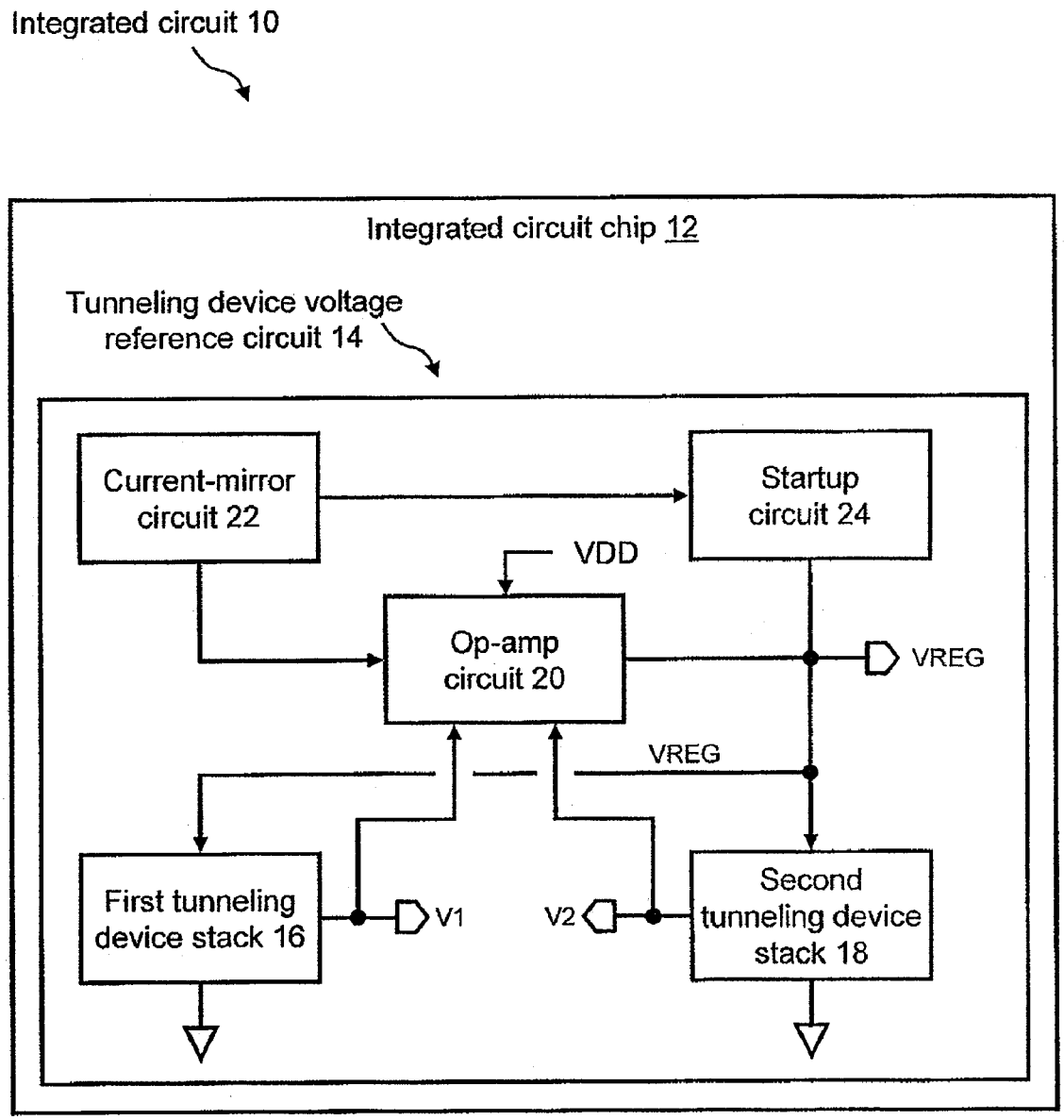
FIG. 1 illustrates a functional block diagram of a design structure made in accordance with the present invention that includes a tunneling device voltage reference circuit for use in low voltage applications.

Referring now to the drawings, FIG. 1 illustrates a design structure comprising integrated circuit 10 of the present invention that may be fabricated upon an integrated circuit chip 12 and that includes at least one tunneling device (TD)

voltage reference circuit 14 made in accordance with the present disclosure. As described below in more detail, TD reference circuit 14 generally comprises a first device stack 16 that includes a first output voltage node V1 having a first voltage V1 that varies linearly with the voltage (here VDD) of a power supply (not shown) and a second device stack 18 that includes a second output voltage node V2 having a second voltage V2 that varies non-linearly with voltage VDD. (For convenience, certain voltage nodes and the voltages on those nodes are designated by the same descriptors, e.g., voltage node V1 has first voltage V1, voltage node V2 has second voltage V2, etc.) TD voltage reference circuit 14 may be electrically connected to one or more logic circuits, analog circuits, and/or mixed-signal circuits (not shown) within integrated circuit 10 as needed in a particular design. Those skilled in the art will readily appreciate the variety of circuits that may be used with TD voltage reference circuit 14. TD voltage reference circuit 14 of integrated circuit 10 also may include a differential operational amplifier (op-amp) circuit 20, a current-mirror circuit 22, and a startup circuit 24.

TD voltage reference circuit 14 may be used in place of a diode-style band gap reference circuit and may be designed to operate with power supply voltages that are relatively low, e.g., less than about 1 volt, to output a voltage reference, which may be any one of the first voltage V1, the second voltage V2, and regulated output voltage VREG, that is very stable across process and temperature variations. At a very high level and as explained in more detail below, TD voltage reference circuit 14 utilizes differential op-amp circuit 20 in a feedback loop to compare first and second output voltages V1, V2 of first and second device stacks 16, 18 with one another and output regulated output voltage VREG as a function of the first and second voltages V1, V2, respectively. Because of the linear behavior of first device stack 16 and the non-linear behavior of second device stack 18, there is a single non-zero value of regulated voltage VREG at which the first and second voltages V1, V2 are equal to one another. Once TD voltage reference circuit 14 locks onto this value, regulated voltage VREG and first and second voltages V1, V2 remain highly stable amid process and temperature variations.

At a more detailed level, first device stack 16 may include two similar n-type transistors N1, N2 (FIG. 2) electrically connected in series with one another and biased in a current tunneling mode in order to form a linear voltage divider. Alternatively, first device stack 16 may be formed of other devices, such as a resistor divider network. Intermediate voltage node V1 exists between the two similar devices N1, N2. Second device stack 18 may include a stack of two dissimilar n-type transistors N3, N4 (FIG. 2) electrically connected in series with one another and biased in a current tunneling mode in order to form a non-linear voltage divider. Intermediate voltage node V2 exists between the two dissimilar tunneling devices. The upper rails of first tunneling device stack 16 and second tunneling device stack 18 are connected to differential op-amp circuit 20 so as to be at the regulated voltage VREG.

In the example of TD voltage reference circuit 14, op-amp circuit 20 is arranged in a negative feedback configuration for sensing a difference in voltage as between first output node V1 of first device stack 16 and second output node V2 of second device stack 18 and then taking corrective action to either increase or decrease regulated voltage VREG until first and second output voltages V1, V2 are substantially equal to one another. More details of differential op-amp circuit 20 are discussed below in the description of FIG. 2.

Current-mirror circuit 22 may be a general-purpose current source that provides gate bias voltages for positive field-effect transistors (pFETs) and/or negative field-effect transistors (nFETs). More details of current-mirror circuit 22 may be found below in the description of FIG. 2. Startup circuit 24 may be a general-purpose startup circuit. A startup circuit is often required with a bi-stable circuit, such as TD voltage reference circuit 14, so that the circuit will stabilize at a preferred operating point at power up time. More details of startup circuit 24 are found below in the description of FIG. 2.

Figure 2:
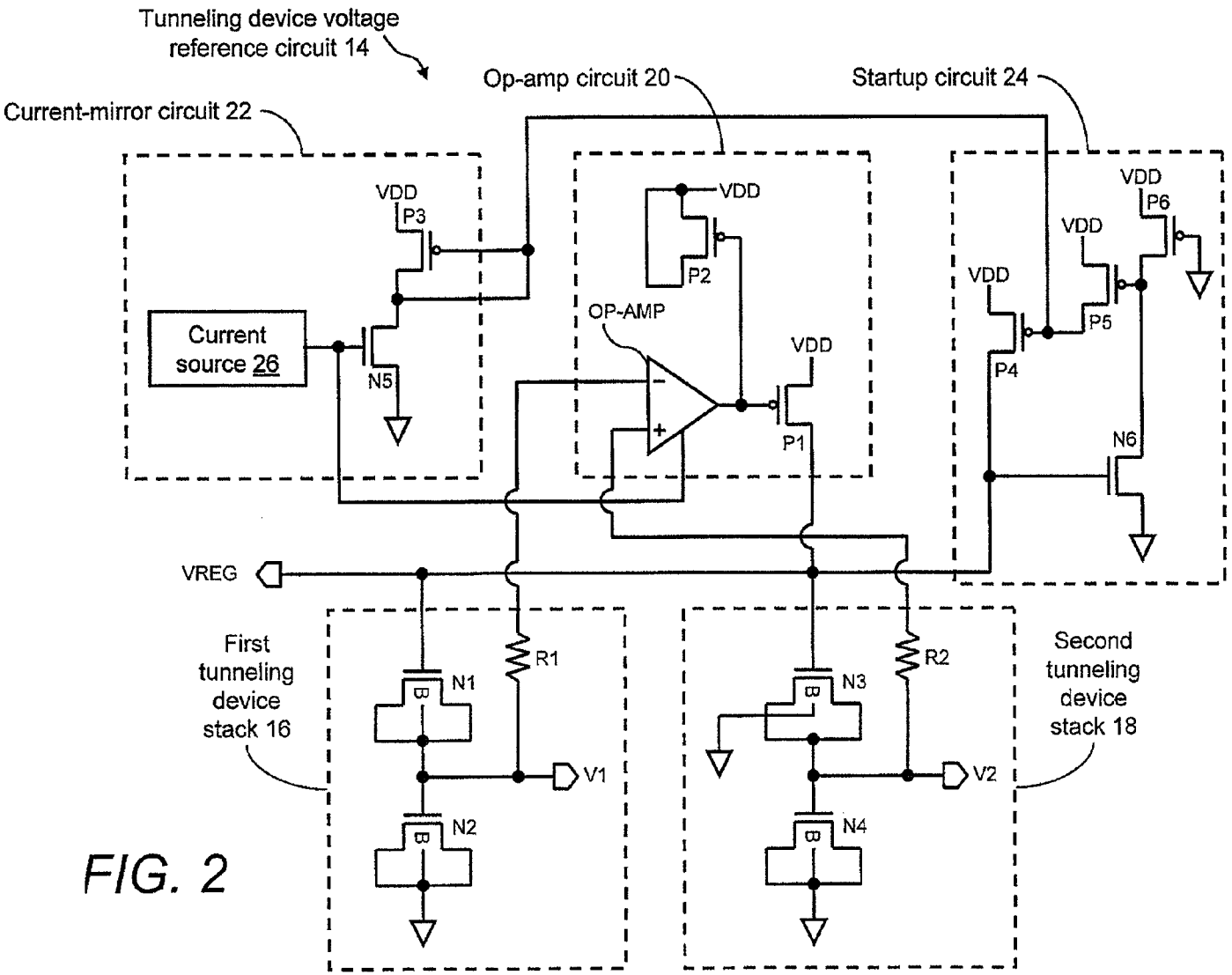
FIG. 2 illustrates a schematic diagram of the tunneling device voltage reference circuit of FIG. 1.

FIG. 2 illustrates TD voltage reference circuit 14 of FIG. 1 in more detail. As mentioned above, first device stack 16 may include a stack of two similar transistors that are biased in a current tunneling mode in order to form a first voltage divider circuit. As shown in FIG. 2, in one example of TD voltage reference circuit 14, first device stack 16 includes nFETs N1, N2 biased in a current tunneling mode and electrically connected in series between voltage node VREG and ground. Voltage node VREG is the voltage node of TD voltage reference circuit 14 that is regulated by the feedback circuitry. Due to the likeness of transistors N1, N2, voltage V1 on intermediate voltage node V1 located between transistors N1, N2 is substantially equal to regulated voltage VREG×0.5 (or VREG/2). The bulk node B of transistor N1 is electrically connected to voltage node V1 and the bulk node B of transistor N2 is electrically connected to ground. Alternatively, first device stack 16 may be formed of a resistor divider network. In addition, first voltage V1 is not limited to a value of VREG/2; rather, the devices that form first tunneling device stack 16 may be sized such that voltage V1 equals any division of regulated voltage VREG.

In the present example, transistors N1, N2 have substantially equal oxide thickness, substantially equal voltage thresholds (Vts), and substantially equal oxide areas. The range of oxide thickness is such that a tunneling current can flow through transistors N1, N2. This range may be, e.g., about 4.0 nanometers (nm) down to about 0.8 nm. In one example, the oxide thickness of each transistor N1, N2 is 1.40 nm. The range of Vt may be about 100 millivolts (mV) to about 400 mV, which may be considered a typical or "normal-Vt" range for such devices. In one example, the normal-Vt of both transistors N1, N2 may be 0.347 V. The oxide area is expressed in terms of channel width W and length L in microns. The only requirement on the oxide area of transistors N1, N2 is that each is at least 1.0 square micron with dimensions of at least 1.0 micron×1.0 micron. This condition is to allow the Vt of transistors N1, N2 to be independent of the variations in the W/L ratio. In one example, the W/L ratio of each transistor N1, N2 may be 5.0/10.0 microns. Because the oxide area of transistors N1, N2 are equal, the voltage across transistor N1 is equal to the voltage across transistor N2 and, thus, first voltage V1 is substantially equal to one-half of regulated voltage VREG. Consequently, first voltage V1 has a linear relationship to regulated voltage VREG.

As also mentioned above, second device stack 18 may include a stack of two dissimilar nFETs N3, N4 electrically connected in series between VREG and ground and biased in a current tunneling mode in order to form a second voltage divider circuit. Intermediate voltage node V2 is located between transistors N3 and N4. The bulk nodes B of corresponding respective transistors N3, N4 may be electrically connected ground. In one embodiment, transistors N3, N4 have substantially equal oxide thicknesses, but have unequal oxide areas and unequal Vts. Like transistors N1, N2 of first device stack 16, the oxide thickness range for transistors N3, N4 may be, e.g., about 4.0 nm down to about 0.8 nm. In one example, the oxide thickness of each transistor N3, N4 is 1.4 nm.

In the present example and like transistors N1, N2, transistor N3 may be considered a normal-Vt device. However, transistor N4 may be considered a low-Vt or an ultra-low-Vt device as compared with each of transistors N1, N2, N3. A low-Vt range may be considered to be about 0.0 mV to about 200 mV. In one example, the low-Vt of transistor N4 may be 0.128 V. An ultra-low-Vt range may be considered to be about −200 mV to about 100 mV. In one example, the ultra-low-Vt of transistor N4 may be 0.026 V. Alternatively, transistor N4 may be considered a high-Vt device as compared with transistor N3. A high-Vt range may be about 300 mV to about 600 mV. In one example, the high-Vt of transistor N4 may be 0.573 V. Because transistors N1, N2, N3, N4 are low-Vt, normal-Vt, or high-Vt devices, when power supply voltage VDD is 1.0 volt or less, there is sufficient voltage margin within TD voltage reference circuit 14 to allow device operation, which is not the case in the traditional diode-style band gap reference circuits.

Like transistors N1, N2, the only requirement on the oxide areas of transistors N3, N4 is that each is at least 1.0 square micron with dimensions of at least 1.0×1.0 micron. In one example, the W/L of transistor N3 may be 130.0/10.0 microns and the W/L of transistor N4 may be 200.0/2.0 microns. Because the Vt of transistors N3, N4 are unequal, the gate tunneling current characteristics of transistors N3, N4 are different and, thus, the voltage across transistor N3 is not equal to the voltage across transistor N4. Consequently, second voltage V2 has a nonlinear relationship to regulated voltage VREG and, thus, second voltage V2 is not simply equal to one-half of regulated voltage VREG.

Additionally, because first device stack 16 and second device stack 18 are formed of very low current devices, it is easy to disturb voltage nodes V1, V2, respectively. Therefore, first device stack 16 and second device stack 18 may each include a corresponding isolation resistor R1, R2. Isolation resistor R1, which is electrically connected to voltage node V1, and isolation resistor R2, which is electrically connected to voltage node V2, provide resistive isolation between first device stack 16 and second device stack 18, respectively, and op-amp circuit 20, in order to inhibit noise that may alter the stack voltages. The resistance values of isolation resistors R1, R2 may range sufficiently high to provide good isolation, but not so high as to diminish the loop gain of op-amp circuit 20. In one example, the resistance values of isolation resistors R1, R2 may each be 10,000 ohms.

Op-amp circuit 20 may be a differential operational amplifier circuit arranged in a negative feedback configuration for sensing a difference between two voltages and then taking corrective action to either increase or decrease a voltage node. Op-amp circuit 20 may include a standard, high gain, operational amplifier OP-AMP device whose negative input is fed by first voltage V1 of first device stack 16 via isolation resistor R1 and whose positive input is fed by second voltage V2 of second device stack 18 via isolation resistor R2. An output of operational amplifier OP-AMP feeds the gates of transistors P1, P2. Transistor P2 serves as a decoupling capacitor between output of operational amplifier OP-AMP and the power supply voltage, e.g., voltage VDD, in order to ensure stability of operational amplifier OP-AMP and the negative feedback configuration. Transistor (P1), which is electrically connected between supply voltage VDD and regulated voltage node VREG, may be the gain stage of operational amplifier OP-AMP that is used to regulate regulated voltage VREG. In response to the output of operational amplifier OP-AMP, transistor P1 supplies current to regulated voltage node VREG, which is the upper rail voltage of first device stack 16 and second device stack 18. In this way, the negative feedback loop is closed.

In particular, operational amplifier OP-AMP senses the difference between the first and second voltage nodes V1, V2 of first and second device stacks 16, 18, respectively, and controls the gate of transistor P1 that supplies current to regulated voltage node VREG until first and second voltage V1, V2 are equal to one another, which is the point at which equilibrium is reached. Due to the linear nature of first device stack 16 and first voltage V1 and the non-linear nature of second device stack 18 and second voltage V2, there is only one non-zero value of regulated voltage VREG at which first and second voltages V1, V2 are equal to one another. Regulated voltage VREG may vary as a function of the ratio of oxide areas of transistors N3, N4 (N3/N4 device ratio). Therefore, with the oxide area of transistor N3 held constant, regulated voltage VREG may be varied by adjusting the oxide area of transistor N4 and, thereby, changing the N3/N4 device ratio.

Current-mirror circuit 22 may be formed of a current source 26 that feeds an n-type/p-type pair of transistors N5, P3. The output of transistor P3 is a regulated voltage level that may be used to regulate the current through a similar pFET device. Similarly, the output of current source 26 is a regulated voltage level that may be used to regulate the current through a similar nFET device, such as transistor N5. Additionally, current source 26 may provide a current source for operational amplifier OP-AMP of op-amp circuit 20.

TD voltage reference circuit 14 is a bi-stable circuit in that two stability points exist at which first voltage V1 is equal to second voltage V2 and results in a fixed and stable value of regulated voltage VREG. One stability point is V1=V2=0 volts (ground) and the other stability point is V1=V2>0 volts (non-ground), which is the desired stability point. In order to ensure that op-amp circuit 20 seeks the non-ground stability point for regulated voltage VREG while supply voltage VDD is initially ramping up, startup circuit 24 is used. The purpose of startup circuit 24 is to provide an initial non-ground voltage at regulated voltage node VREG at start up time, which allows operational amplifier OP-AMP and transistor P1 to operate with negative feedback in order to regulate regulated voltage VREG so as to seek a non-ground voltage value that allows first voltage V1 to equal second voltage V2.

In the present example, startup circuit 24 is formed of an arrangement of p-type transistors (pFETs) P4, P5, and P6 as well as an n-type transistor (nFET) N6, which are electrically connected as shown in FIG. 2. Transistor P4, which provides the start voltage to regulated voltage node VREG, is controlled by the pair of transistors N5, P3 of current-mirror circuit 22. More specifically, when TD voltage reference circuit 14 is powered on, transistor P4 of startup circuit 24 lifts regulated voltage VREG to a value between the power supply voltage (e.g., voltage VDD) and ground. Startup circuit 24 shuts off after power up. More specifically, startup circuit 24 is shut off via transistor N6, which is turned on when regulated voltage VREG rises sufficiently to turn on transistor N6, which pulls the drain of transistor N6 to ground, which then turns on transistor P5, which then pulls the drain of transistor P5 to supply voltage VDD, which then pulls the gate of transistor P4 to supply voltage VDD, which then turns off transistor P4. Once regulated voltage node VREG is not at ground because of the action of startup circuit 24, and once startup circuit 24 is turned off, operational amplifier OP-AMP begins its negative feedback operation and seeks the stable non-ground value of regulated voltage VREG at which V1=V2.

Figure 3:
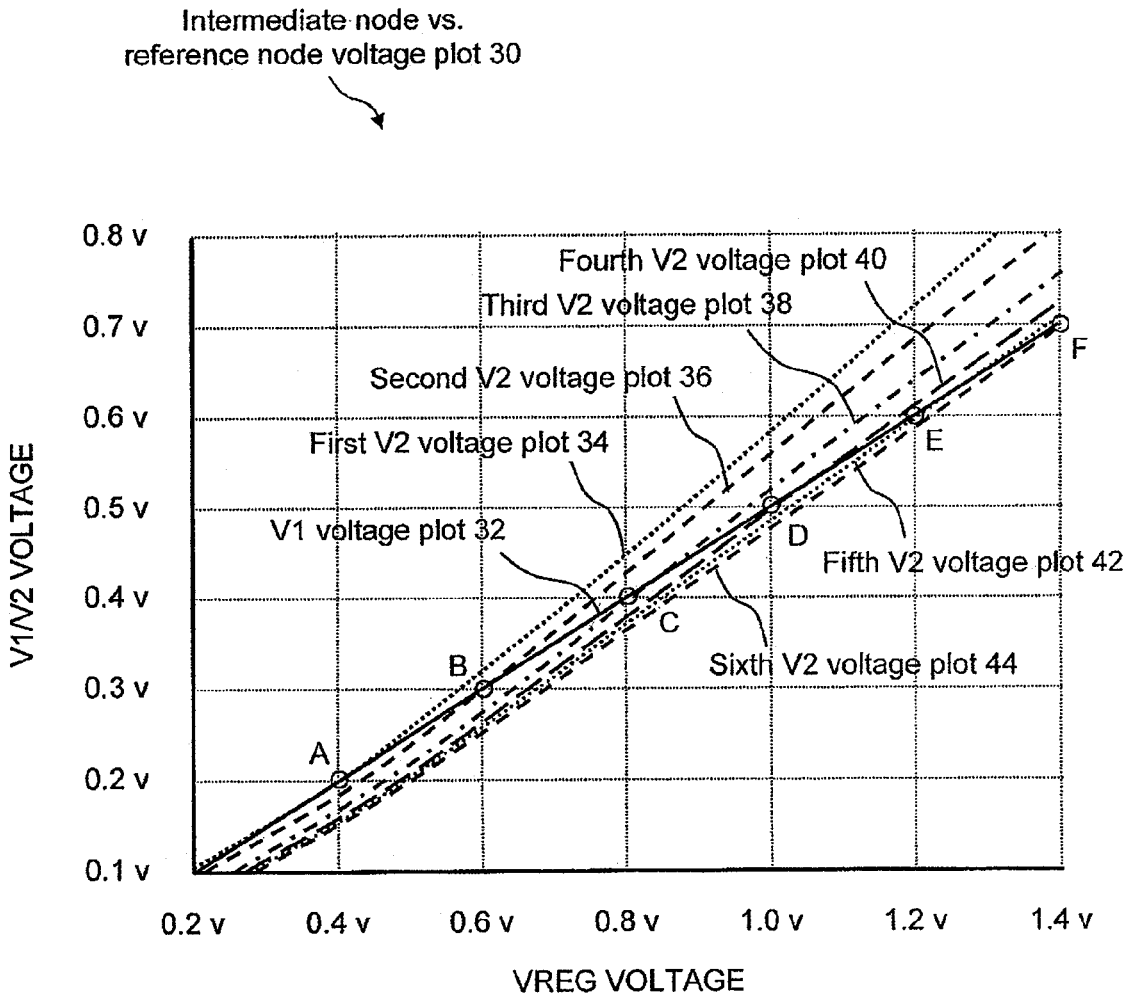
FIG. 3 illustrates an exemplary intermediate node vs. reference node voltage plot for various device ratios within a second of two tunneling device stacks of the tunneling device voltage reference circuit of FIG. 2.

FIG. 3 illustrates an example intermediate node vs. reference node voltage plot 30 for various device ratios within second device stack 18 of TD voltage reference circuit 14 of FIG. 2. In particular and referring again to FIG. 2, when regulated voltage VREG is ramping up, intermediate node vs. reference node voltage plot 30 shows multiple examples of how there is one point only at which first voltage V1, which again has a linear relationship to regulated voltage VREG, and second voltage V2, which has a nonlinear relationship to regulated voltage VREG, are equal. This crossover point is a function of the N3/N4 device ratio of second device stack 18. The x-axis of intermediate node vs. reference node voltage plot 30 corresponds to regulated voltage VREG and the y-axis corresponds to first and second voltages V1, V2 of FIG. 2.

Intermediate node vs. reference node voltage plot 30 shows a plot of a V1 voltage ramp 32, which in every scenario is substantially equal to VREG/2 because it has a linear relationship to regulated voltage VREG. In a first example, intermediate node vs. reference node voltage plot 30 shows a plot of a first V2 voltage ramp 34 that intersects with V1 voltage ramp 32 at a point A only, at which each of first and second voltages V1, V2 equals 200 mV, which is the result of an N3/N4 device ratio of 11.92. More details of the circuit conditions that generate first V2 voltage ramp 34 are shown in Example No. 1 of Table 1 below.

In a second example, intermediate node vs. reference node voltage plot 30 shows a plot of a second V2 voltage ramp 36 that intersects with V1 voltage ramp 32 at a point B only, at which each of first and second voltages V1, V2 equals 300 mV, which is the result of an N3/N4 device ratio of 7.09. More details of the circuit conditions that generate second V2 voltage ramp 36 are shown in Example No. 2 of Table 1 below.

In a third example, intermediate node vs. reference node voltage plot 30 shows a plot of a third V2 voltage ramp 38 that intersects with V1 voltage ramp 32 at a point C only, at which each of first and second voltages V1, V2 equals 400 mV, which is the result of an N3/N4 device ratio of 3.64. More details of the circuit conditions that generate third V2 voltage ramp 38 are shown in Example No. 3 of Table 1 below.

In a fourth example, intermediate node vs. reference node voltage plot 30 shows a plot of a fourth V2 voltage ramp 40 that intersects with V1 voltage ramp 32 at a point D only, at which each of first and second voltages V1, V2 equals 500 mV, which is the result of an N3/N4 device ratio of 2.52. More details of the circuit conditions that generate fourth V2 voltage ramp 40 are shown in Example No. 4 of Table 1 below.

In a fifth example, intermediate node vs. reference node voltage plot 30 shows a plot of a fifth V2 voltage ramp 42 that intersects with V1 voltage ramp 32 at a point E only, at which each of first and second voltages V1, V2 equals 600 mV, which is the result of an N3/N4 device ratio of 2.09. More details of the circuit conditions that generate fifth V2 voltage ramp 42 are shown in Example No. 5 of Table 1 below.

In a sixth example, intermediate node vs. reference node voltage plot 30 shows a plot of a sixth V2 voltage ramp 44 that intersects with V1 voltage ramp 32 at a point F only, at which each of first and second voltages V1, V2 equals 700 mV, which is the result of an N3/N4 device ratio of 1.85. More details of the circuit conditions that generate sixth V2 voltage ramp 44 are shown in Example No. 6 of Table 1 below.

TABLE 1

Example circuit conditions and resulting voltages V1, V2, and VREG

| Example No. | VDD (volts) | Oxide thickness (nm) | N1&N2 W/L (microns) | N3 W/L (microns) | N4 W/L (microns) | N3/N4 device ratio | V1 = V2 voltage (mV) | VREG voltage (mV) |
|---|---|---|---|---|---|---|---|---|
| 1 | >500 mv | 1.40 | 5.0/10 | 130/10 | 10.9/10 | 11.92 | 200 | 400 |
| 2 | >700 mv | 1.40 | 5.0/10 | 130/10 | 18.33/10 | 7.09 | 300 | 600 |
| 3 | >900 mv | 1.40 | 5.0/10 | 130/10 | 35.71/10 | 3.64 | 400 | 800 |
| 4 | >1100 mv | 1.40 | 5.0/10 | 130/10 | 51.58/10 | 2.52 | 500 | 1000 |
| 5 | >1300 mv | 1.40 | 5.0/10 | 130/10 | 62.2/10 | 2.09 | 600 | 1200 |
| 6 | >1500 mv | 1.40 | 5.0/10 | 130/10 | 70.27/10 | 1.85 | 700 | 1400 |

Note:
In all examples, N1, N2, & N3 are normal-Vt devices and N4 is low-Vt device.

Figure 4:
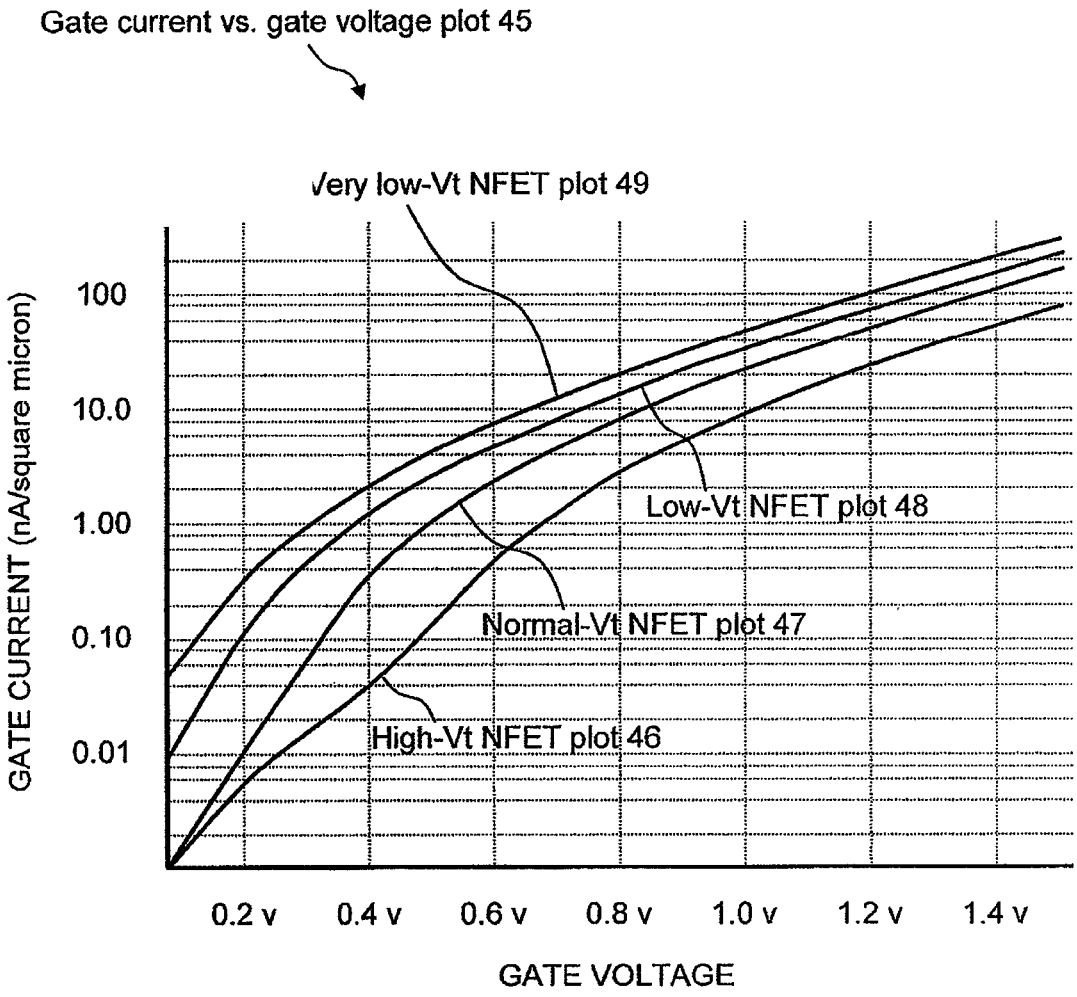
FIG. 4 is a graph showing the relative tunneling current of high-Vt, normal-Vt, low-Vt and very low-Vt devices as a function of gate voltage.

Intermediate node vs. reference node voltage plot 30 of FIG. 3 and Table 1 illustrate how modifying, for example, the N3/N4 device ratio of second device stack 18 allows the point at which second voltage V2 becomes equal to first voltage V1 to change. In doing so, any of voltages V1, V2, and VREG may be used and adjusted for a desired application It is demonstrated in Table 1 that as N3/N4 device ratio is decreased, the intermediate second voltage V2 becomes larger. This can be explained by the difference in tunneling current of a normal-Vt device versus that of a low-Vt device at a given gate voltage. A gate current vs. gate voltage plot 45 of FIG. 4 shows gate tunneling current as a function of gate voltage for high-Vt (i.e., high-Vt nFET plot 46), normal-Vt (i.e., normal-Vt nFET plot 47), low-Vt (i.e., low-Vt nFET plot 48), and very low-Vt (i.e., very low-Vt nFET plot 49) devices. For a given gate voltage, the current per square micrometer of gate-oxide area increases as the Vt of the device decreases. It can also be seen that as gate voltage is increased, this difference between the low-Vt device current and the normal-Vt device current reduces.

The voltage reference circuit of FIG. 2 uses negative feedback to determine the value of regulated voltage VREG where first voltage V1 equals second voltage V2, and because first voltage V1 is essentially one-half of regulated voltage VREG, and the current through device N3 equals the current through device N4, it follows that the voltage across device N3 must equal the voltage across device N4, which equals second voltage V2. Hence the gate to source/drain voltages on devices N3, N4 are equal so their relative current densities can be found by inspection of the normal-Vt curve, and the low-Vt curve found respectively in FIG. 4. The current density of the low-Vt device (N4), is higher than that of the normal-Vt device (N3), so it follows that device N4 requires a smaller relative device area for equal tunneling current at equal gate to source/drain voltages. At higher gate voltages, the difference between the low-Vt device current and the normal-Vt device current is reduced so the area of low-Vt device N4 must be increased over its value at lower gate voltages. The device ratio of N3/N4 can be adjusted higher or lower from the current density curves of FIG. 4 to chose reference voltages from among regulated voltage VREG, first voltage V1 and second voltage V2 as desired.

Figure 5:
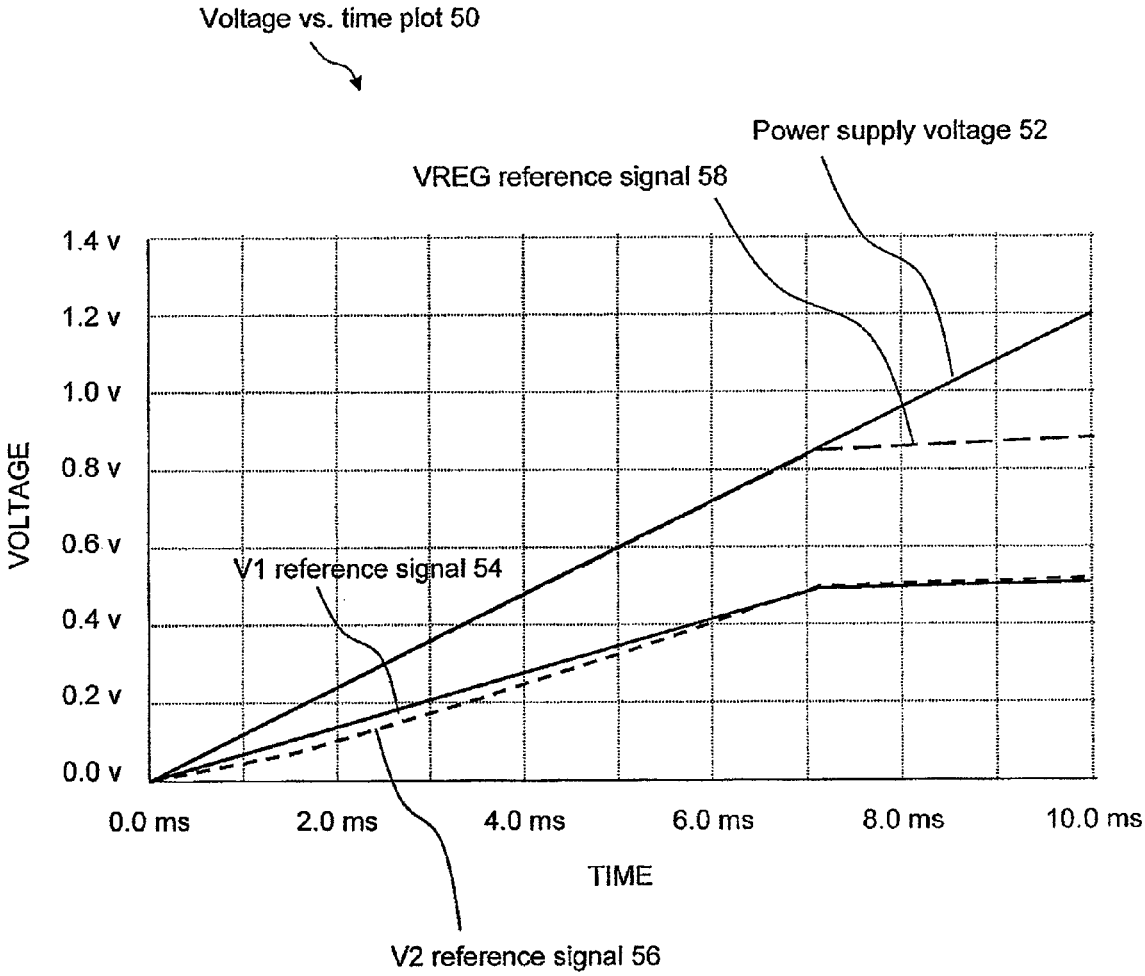
FIG. 5 illustrates a first exemplary voltage vs. time plot of the regulated voltages of the tunneling device voltage reference circuit of FIGS. 1 and 2 as power supply is ramped up.
Figure 6:
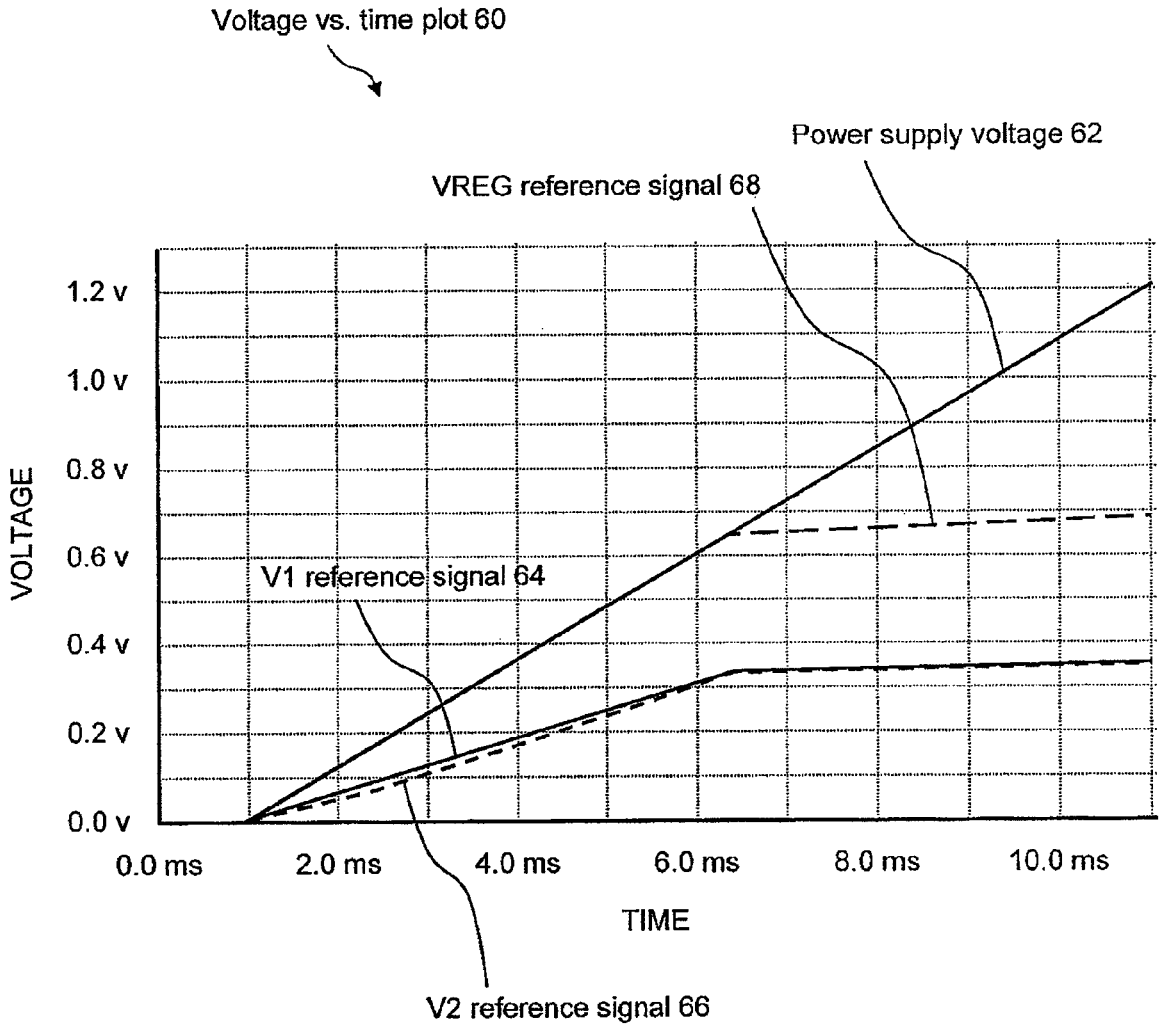
FIG. 6 illustrates a second exemplary voltage vs. time plot of the regulated voltages of the tunneling device voltage reference circuit of FIGS. 1 and 2 as power supply is ramped up.

Additional examples of circuit conditions that produce voltages V1, V2, and VREG of TD voltage reference circuit 14 are shown in Table 2. Further to the example, a plot of Example No. 4 of Table 2 is shown in FIG. 5 and a plot of Example No. 3 of Table 2 is shown in FIG. 6.

TABLE 2

Example circuit conditions and resulting voltages V1, V2, and VREG

| Example No. | VDD (volts) | Oxide thickness (nm) | N1&N2 W/L (microns) | N3 W/L (microns) | N4 W/L (microns) | N3/N4 device ratio | V1 = V2 voltage (mV) | VREG voltage (mV) |
|---|---|---|---|---|---|---|---|---|
| 1 | 1.20 | 1.40 | 5.0/10.0 | 130.0/10.0 | 10.0/10.0 | 13.0 | 180 | 360 |
| 2 | 1.20 | 1.40 | 5.0/10.0 | 130.0/10.0 | 20.0/10.0 | 6.5 | 280 | 560 |
| 3 | 1.20 | 1.40 | 5.0/10.0 | 130.0/10.0 | 200/2 | 3.25 | 330 | 660 |
| 4 | 1.20 | 1.40 | 5.0/10.0 | 130.0/10.0 | 50/10 | 2.6 | 490 | 980 |

Note:
In all examples, N1, N2, & N3 are normal-Vt devices and N4 is low-Vt device Referring again to FIG. 2, example W/L values of the nFETs and pFETs of TD voltage reference circuit 14 that support the W/L values of N1, N2, N3, and N4 shown in Tables 1 and 2 are as follows: P1=30/0.1, P2=60.0/10.0, P3=1.0/0.5, P4=0.5/60.0, P5=2.0/0.3, P6=0.5/60.0, N5=1.0/1.0, and N6=2.0/0.24 (all values of width W and length L are in microns).

FIG. 5 illustrates a first example voltage vs. time plot 50 of the regulated voltage VREG of tunneling device voltage reference circuit 14 of FIGS. 1 and 2. First example voltage vs. time plot 50 illustrates the circuit response to a sweep of Vdd values for Example No. 4 of Table 2. In particular, voltage vs. time plot 50 of FIG. 5 shows voltages V1, V2, and VREG ramping up with a power supply voltage 52 (e.g., VDD) and reaching their fixed and stable states when the supply voltage is about 1 volt and above. More specifically, voltage vs. time plot 50 shows power supply voltage 52 that is ramping from 0 to 1.2 volts, a V1 reference signal 54 that is ramping linearly from 0 volts to a stability point where first voltage V1 equals second voltage V2 at a rate of about VREG/2, a V2 reference signal 56 that is ramping nonlinearly from 0 volts to the stability point where first voltage V1 equals second voltage V2, and a VREG reference signal 58 that is tracking linearly with regulated voltage VREG and locks at a fixed and stable voltage when first voltage V1 equals second voltage V2 because of the action of op-amp circuit 20. In particular, in this example voltages V1, V2 lock in at about 490 mV and regulated voltage VREG locks in at about 860 mV. Voltages V1, V2, and VREG will vary slightly from that shown in FIG. 5 under best case and worst case process conditions. Additionally, overall tolerances of voltages V1, V2, and VREG may be +/−10% or better.

FIG. 6 illustrates a second example voltage vs. time plot 60 of the regulated voltages of tunneling device voltage reference circuit 14 of FIGS. 1 and 2, which demonstrates the circuit response to a sweep of Vdd values for Example No. 3 of Table 2. In particular, voltage vs. time plot 60 of FIG. 6 shows voltages V1, V2, and VREG ramping up with a power supply voltage 62 (e.g., voltage VDD) and reaching their fixed and stable states when the power supply voltage is about 0.6 volts and above. More specifically, voltage vs. time plot 60 shows power supply voltage 62 that is ramping from 0 to 1.2 volts, a V1 reference signal 64 that is ramping linearly from 0 volts to a stability point where first voltage V1 equals second voltage V2 at a rate of about VREG/2, a second V2 reference signal 66 that is ramping nonlinearly from 0 volts to the stability point where first voltage V1 equals second voltage V2, and a VREG reference signal 68 that is tracking linearly with regulated voltage VREG and locks at a fixed and stable voltage when first voltage V1 equals second voltage V2 because of the action of op-amp circuit 20. In particular, in this example first and second voltages V1, V2 lock in at about 330 mV and regulated voltage VREG locks in at about 660 mV. Voltages V1, V2, and VREG will vary slightly from that shown in FIG. 6 under best case and worst case process conditions. Additionally, overall tolerances of voltages V1, V2, and VREG may be +/−10% or better.

A tunneling reference circuit, such as TD voltage reference circuit 14 of FIGS. 1-6, may be used in applications well below a 1.0 volt power supply voltage. This is because transistors N1, N2, N3, N4 are low-Vt, normal-Vt, or high-Vt devices with Vts below 0.7 V. When the power supply voltage is 1.0 volt or less there is sufficient voltage margin within TD voltage reference circuit 14 to allow device operation, which is not the case in the traditional diode-style band gap reference circuits. The tolerances can be +/−10% or better and may be improved with a temperature compensation circuit similar to ones used in traditional band gap reference circuits. Additionally, the operation of TD voltage reference circuit 14 may be extended to power supply voltages lower than 1.0 volt when native Vt or very low Vt devices are available. This circuit technique is highly scaleable because it relies on tunneling current only and is not limited to the turn-on voltage characteristic of transistors as are traditional band gap reference circuits.

Figure 7:
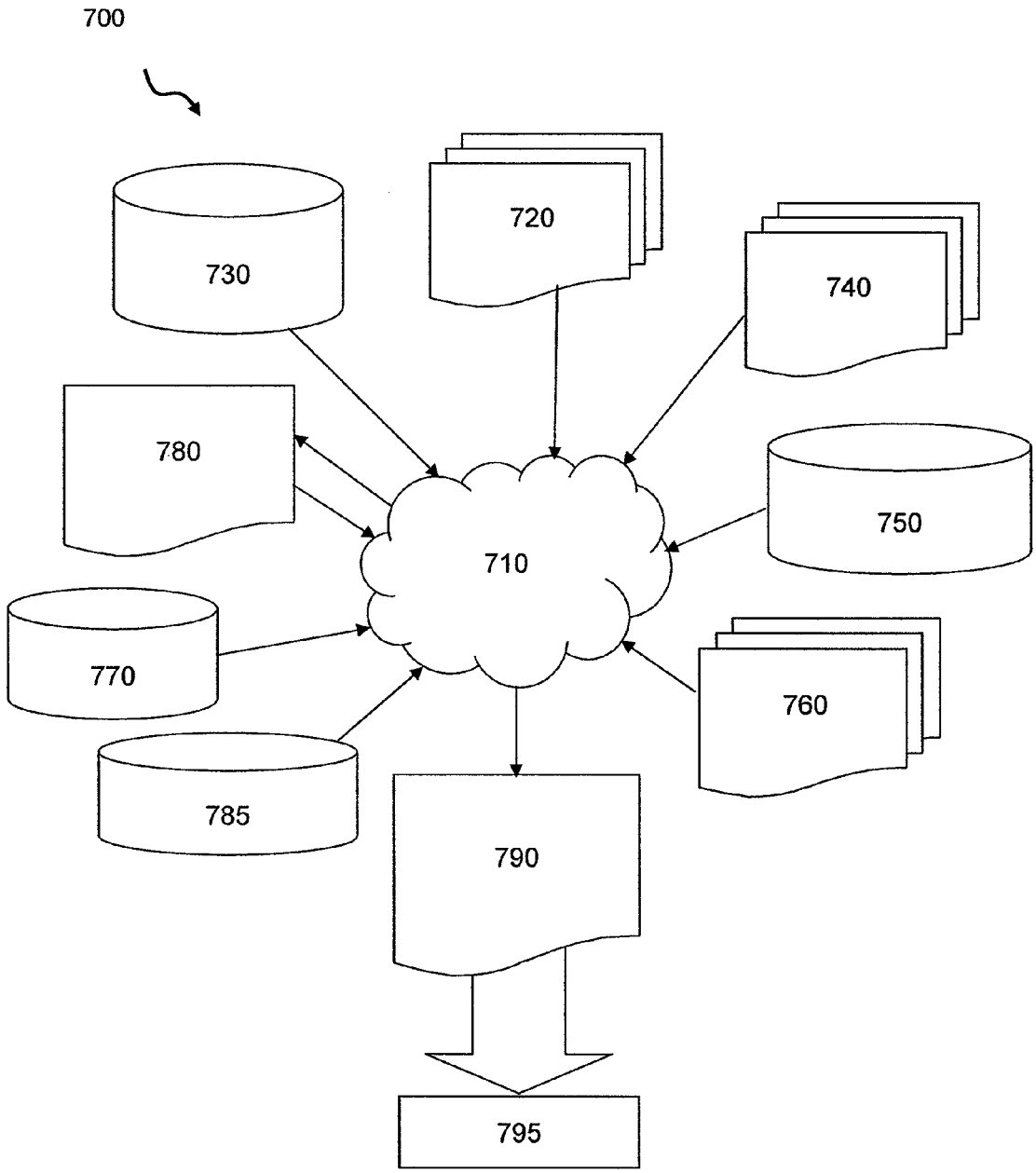
FIG. 7 illustrates an example design flow process used to design integrated circuits.

FIG. 7 shows a block diagram of an example design flow 700. Design flow 700 may vary depending on the type of IC being designed. For example, a design flow 700 for building an application specific IC (ASIC) may differ from a design flow 700 for designing a standard component. Design structure 720 is preferably an input to a design process 710 and may come from an IP provider, a core developer, or other design company or may be generated by the operator of the design flow, or from other sources. Design structure 720 comprises circuit 10 in the form of schematics or HDL, a hardware-description language (e.g., Verilog, VHDL, C, etc.). Design structure 720 may be contained on one or more machine readable medium. For example, design structure 720 may be a text file or a graphical representation of circuit 10. Design process 710 preferably synthesizes (or translates) circuit 10 into a netlist 780, where netlist 780 is, for example, a list of wires, transistors, logic gates, control circuits, I/O, models, etc. that describes the connections to other elements and circuits in an integrated circuit design and recorded on at least one of machine readable medium. This may be an iterative process in which netlist 780 is resynthesized one or more times depending on design specifications and parameters for the circuit.

Design process 710 may include using a variety of inputs; for example, inputs from library elements 730 which may house a set of commonly used elements, circuits, and devices, including models, layouts, and symbolic representations, for a given manufacturing technology (e.g., different technology nodes, 32 nm, 45 nm, 90 nm, etc.), design specifications 740, characterization data 750, verification data 760, design rules 770, and test data files 785 (which may include test patterns and other testing information). Design process 710 may further include, for example, standard circuit design processes such as timing analysis, verification, design rule checking, place and route operations, etc. One of ordinary skill in the art of integrated circuit design can appreciate the extent of possible electronic design automation tools and applications used in design process 710 without deviating from the scope and spirit of the invention. The design structure of the invention is not limited to any specific design flow.

Ultimately, design process 710 preferably translates circuit 10, along with the rest of the integrated circuit design (if applicable), into a final design structure 790 (e.g., information stored in a GDS storage medium). Final design structure 790 may comprise information such as, for example, test data files, design content files, manufacturing data, layout parameters, wires, levels of metal, vias, shapes, test data, data for routing through the manufacturing line, and any other data required by a semiconductor manufacturer to produce circuit 10. Final design structure 790 may then proceed to a stage 795 where, for example, final design structure 790: proceeds to tape-out, is released to manufacturing, is sent to another design house or is sent back to the customer.

Exemplary embodiments have been disclosed above and illustrated in the accompanying drawings. It will be understood by those skilled in the art that various changes, omissions and additions may be made to that which is specifically disclosed herein without departing from the spirit and scope of the present invention.

What is claimed is:

1. A design structure embodied in a machine readable medium, the design structure comprising:

a voltage reference circuit that includes:

a first voltage divider stack comprising:

a first input for receiving a regulated voltage; and a first internal node for providing a first divided output voltage;

a second voltage divider stack electrically coupled in parallel with said first voltage divider stack and having a nonlinear relationship to said regulated voltage, said second voltage divider stack comprising:

a second input for receiving said regulated voltage; and a second internal node for providing a second divided output voltage; and a voltage regulator operatively configured to generate said regulated voltage as a function of said first divided output voltage and said second divided output voltage, wherein:

said second voltage divider stack comprises a first leaky capacitor and a second leaky capacitor coupled in series with one another so as to define said second internal node said first leaky capacitor has a first leakage current and comprises a first transistor having a first gate oxide and said first leakage current is provided by current tunneling across said first gate oxide;

said second leaky capacitor has a second leakage current and comprises a second transistor having a second gate oxide and said second leakage current is provided by current tunneling across said second gate oxide; and said first transistor is a low-voltage-threshold device and said second transistor is a regular-voltage-threshold device.

2. The design structure of claim 1, wherein said first gate oxide has a first area and said second gate oxide has a second area different from said first area.

3. The design structure of claim 1, wherein said first voltage divider stack comprises a third leaky capacitor and a fourth leaky capacitor coupled in series with one another so as to define said first internal node.

4. The design structure of claim 3, wherein:

said third leaky capacitor has a third leakage current and comprises a third transistor having a third gate oxide and said third leakage current is provided by current tunneling across said third gate oxide; and said fourth leaky capacitor has a fourth leakage current and comprises a fourth transistor having a fourth gate oxide and said fourth leakage current is provided by current tunneling across said fourth gate oxide.

5. A design structure embodied in a machine readable medium, the design structure comprising:

a voltage reference circuit that includes:

a first voltage divider stack comprising:

a first input for receiving a regulated voltage; and a first internal node for providing a first divided output voltage;

a second voltage divider stack electrically coupled in parallel with said first voltage divider stack and having a nonlinear relationship to said regulated voltage, said second voltage divider stack comprising:

a second input for receiving said regulated voltage; and a second internal node for providing a second divided output voltage; and a voltage regulator operatively configured to generate said regulated voltage as a function of said first divided output voltage and said second divided output voltage, wherein said second voltage divider stack comprises a first leaky capacitor and a second leaky capacitor coupled in series with one another so as to define said second internal node said first leaky capacitor has a first leakage current and comprises a first transistor having a first gate oxide and said first leakage current is provided by current tunneling across said first gate oxide;

said second leaky capacitor has a second leakage current and comprises a second transistor having a second gate oxide and said second leakage current is provided by current tunneling across said second gate oxide; and said voltage regulator comprises a differential amplifier, and a gain stage device responsive to a gain stage control voltage and for outputting said regulated voltage, said differential amplifier for receiving and operating on said first divided output and said second divided output so as to output said gain stage control voltage.

6. A design structure embodied in a machine readable medium, the design structure comprising:

a voltage reference circuit that includes:

a first voltage divider stack comprising:

a first input for receiving a regulated voltage; and a first internal node for providing a first divided output voltage;

a second voltage divider stack electrically coupled in parallel with said first voltage divider stack and comprising:

a first leaky capacitor having a first leakage current and including a second input for receiving said regulated voltage; and a second leaky capacitor electrically coupled in series with said first leaky capacitor so as to define a second internal node therebetween for providing a second divided output voltage; and a voltage regulator operatively configured to generate said regulated voltage as a function of said first divided output voltage and said second divided output voltage wherein:

said first leaky capacitor comprises a first transistor having a first gate oxide and said first leakage current is provided by current tunneling across said first gate oxide;

said second leaky capacitor comprises a second transistor having a second gate oxide and said second leakage current is provided by current tunneling across said second gate oxide; and said first transistor is a low-voltage-threshold device and said second transistor is a regular-voltage-threshold device.

7. The design structure of claim 6, wherein said first voltage divider stack comprises a third leaky capacitor and a fourth leaky capacitor coupled in series with one another so as to define said first internal node.

8. The design structure of claim 7, wherein:

said third leaky capacitor has a third leakage current and comprises a third transistor having a third gate oxide and said third leakage current is provided by current tunneling across said third gate oxide; and said fourth leaky capacitor has a fourth leakage current and comprises a fourth transistor having a fourth gate oxide and said fourth leakage current is provided by current tunneling across said fourth gate oxide.

9. A design structure embodied in a machine readable medium, the design structure comprising:

a voltage reference circuit that includes:

a first voltage divider stack comprising:

a first input for receiving a regulated voltage; and a first internal node for providing a first divided output voltage;

a second voltage divider stack electrically coupled in parallel with said first voltage divider stack and comprising:

a first leaky capacitor having a first leakage current and including a second input for receiving said regulated voltage; and a second leaky capacitor electrically coupled in series with said first leaky capacitor so as to define a second internal node therebetween for providing a second divided output voltage; and a voltage regulator operatively configured to generate said regulated voltage as a function of said first divided output voltage and said second divided output voltage wherein:

said first leaky capacitor comprises a first transistor having a first gate oxide and said first leakage current is provided by current tunneling across said first gate oxide;

said second leaky capacitor comprises a second transistor having a second gate oxide and said second leakage current is provided by current tunneling across said second gate oxide;

said voltage regulator comprises a differential amplifier, and a gain stage device responsive to a gain stage control voltage and for outputting said regulated voltage, said differential amplifier for receiving and operating on said first divided output and said second divided output so as to output said gain stage control.

10. A design structure embodied in a machine readable medium, the design structure comprising:

a voltage reference circuit that includes:

a first voltage divider stack comprising:

a first input for receiving a regulated voltage; and a first internal node for providing a first divided output voltage;

a second voltage divider stack electrically coupled in parallel with said first voltage divider stack and comprising:

a first leaky capacitor having a first leakage current and including a second input for receiving said regulated voltage; and a second leaky capacitor electrically coupled in series with said first leaky capacitor so as to define a second internal node therebetween for providing a second divided output voltage; and a voltage regulator operatively configured to generate said regulated voltage as a function of said first divided output voltage and said second divided output voltage, wherein said voltage regulator comprises a differential amplifier, and a gain stage device responsive to a gain stage control voltage and for outputting said regulated voltage, said differential amplifier for receiving and operating on said first divided output and said second divided output so as to output gain stage control.

* * * * *